United States Patent [19]

Doi et al.

[11] Patent Number: 4,576,127

[45] Date of Patent: Mar. 18, 1986

[54] VALVE TIMING CONTROL DEVICE FOR AN INTERNAL COMBUSTION ENGINE

[75] Inventors: Isao Doi, Isehara; Takashi Mihashi, Yokosuka; Shoichiro Yokota, Yokohama, all of Japan

[73] Assignee: Nissan Motor Co., Ltd., Yokohama City, Japan

[21] Appl. No.: 732,716

[22] Filed: May 10, 1985

[30] Foreign Application Priority Data

May 14, 1984 [JP] Japan ..... 59-94669

[51] Int. Cl.[4] ..... F01L 1/12

[52] U.S. Cl. ..... 123/90.15; 123/90.27; 123/90.31

[58] Field of Search ..... 123/90.15, 90.27, 90.31

[56] References Cited

U.S. PATENT DOCUMENTS

| | | | |
|---|---|---|---|
| 2,010,056 | 8/1935 | Brush | 123/90.31 |
| 3,888,217 | 6/1975 | Hisserich | 123/90.15 |
| 4,174,683 | 11/1979 | Vivian | 123/90.15 |
| 4,177,689 | 12/1979 | Zeilinger et al. | 123/90.31 |
| 4,480,603 | 11/1984 | Tsuboi | 123/90.31 |
| 4,484,543 | 11/1984 | Maxey | 123/90.15 |
| 4,525,151 | 6/1985 | Tomita et al. | 123/90.15 |

FOREIGN PATENT DOCUMENTS

| | | | |
|---|---|---|---|
| 144614 | 8/1983 | Japan | 123/90.31 |
| 143107 | 8/1983 | Japan | 123/90.31 |
| 15612 | 1/1984 | Japan | 123/90.27 |
| 12108 | 1/1984 | Japan | 123/90.15 |
| 70820 | 4/1984 | Japan | 123/90.31 |
| 2128679 | 4/1984 | United Kingdom | 123/90.27 |

*Primary Examiner*—Ira S. Lazarus

*Attorney, Agent, or Firm*—Schwartz, Jeffery, Schwaab, Mack, Blumenthal & Evans

[57] ABSTRACT

A first timing belt transmits rotation of a crankshaft to an exhaust valve operating camshaft whose rotation is in turn transmitted through a second timing belt to an intake valve operating camshaft. A pair of adjusting pulleys are provided which is brought into contact with a tension side section and a slack side section of the second timing belt and movable in unison with each other toward and away from the timing belt sections to vary the lengths of same and thereby vary the phase of the intake valve operating camshaft relative to the exhaust valve operating camshaft in accordance with operating conditions of the engine.

7 Claims, 4 Drawing Figures

VALVE TIMING CONTROL DEVICE FOR AN INTERNAL COMBUSTION ENGINE

BACKGROUND OF THE INVENTION

1. Field of the Invention

The present invention relates in general to internal combustion engines of automotive vehicles and more particularly to a device for controlling the phase of a camshaft for operating a valve of an internal combustion engine and thereby controlling the valve timing in order to obtain optimum efficiency and performance of the engine throughout the operating speed.

2. Description of the Prior Art

A valve timing control device of the type adapted to control the phase of a camshaft (i.e. a camshaft angle relative to a crankshaft angle) by advancing and retarding a power transmitting member such as for example a timing belt used in a drive arrangement connected to the camshaft is disclosed, for example, in Japanese Provisional Patent Publication No. 52-31214 and also shown in FIG. 4.

In the figure, 41 is a crankshaft serving as an output shaft of an engine, and 42, 43 are camshafts mounted above a cylinder head (no numeral) to control the opening and closing of intake and exhaust valves (not shown), respectively. On the crankshaft 41 a driving wheel 42 is mounted and on the camshafts 42, 43 a pair of driven wheels 45, 46 are mounted, respectively. Indicated by the reference numeral 47 is a power transmitting member in the form of a single, endless strip, passing about the driving and driven wheels 44–46.

The power transmitting member 47 is in effect a timing chain, timing belt or flat belt. In the case of a timing chain or belt, sprockets are used as the driving and driven wheels 44–46 and in the case of a flat belt pulleys are used. Hereinbelow, the power transmitting member 47 is described as a timing belt but not limited to it.

The timing belt 47 have three belt sections extending between the adjacent two of the sprockets 44–46, which belt sections respectively pass over idler pulleys 48–50 disposed outside of the timing belt 47 to serves as adjusting wheels for adjusting the lengths of the timing belt sections and thereby varying the valve timing. The idler pulleys 48–50 are driven by a drive unit including cylinders 51–53 and movable toward and away from the timing belt 47. The cylinders 51–53 are extensible and contractible in response to variation in various engine parameters such as engine r.p.m., load, etc.

With the above described valve timing control device, upon adjustment of the relative phase between the camshafts 42, 43 through adjustment of the length of the timing belt section extending between the sprockets 45, 46, it is necessary to move the idler pulleys 48, 49 toward or away from the associated timing belt sections in order to hold them in a suitably tensioned state. In this connection, since the camshafts 42, 43 are spaced a relatively large distance from the crankshaft 41, the length of the timing belt section extending between the sprockets 44, 45 or 44, 46 is relatively large, resulting in the necessity that the maximum strokes of the idler pulleys 48, 49 are large. Due to this, the drive unit for the idlers 48, 49 inevitably becomes large-sized to increase the width of the engine, causing a difficulty in the arrangement of engine accessories such as a water pump pulley, etc.

Furthermore, due to the fact that the crankshaft 41 is spaced a relatively large distance from the camshafts 42, 43, the timing belt sections extending between the sprockets 44, 45 and 44, 46 are swingable largely during the time when the valve timing is being varied, resulting in the possibility that the timing belt skips over some of the teeth of the sprockets 44–46.

Still furthermore, since increase in the length of the timing belt section between the sprockets 44, 45 or 44, 46 due to secular change is large since the distance which the crankshaft 41 is spaced from the camshafts 42, 43 is large, predetermined movements of the idler pulleys 48, 49 become inappropriate, tending to make the valve timing inappropriate to cause deterioration in the engine output, fuel consumption, exhaust gas components, etc.

Yet furthermore, since the camshafts 42, 43 are adapted to rotate at half the speed of the crankshaft 41, the diameter of each sprockets 45, 46 is twice as large as that of the sprockets 44. For this reason, the distance between the camshafts 42, 43 cannot be reduced to a satisfactory extent, resulting in an increased height of the engine since relative inclination between the intake and exhaust valves cannot be made small to a satisfactory extent and further since the idler pulley 50 and its associated drive unit parts need to be disposed adjacent the outer periphery of the engine.

SUMMARY OF THE INVENTION

In accordance with the present invention, there is provided a novel and improved valve timing control device for an engine having a crankshaft and a pair of camshafts for operating intake and exhaust valves. The valve timing control device comprises a driving wheel mounted on the crankshaft to rotate together therewith, a pair of first and second driven wheels mounted on one of the camshaft to rotate together therewith, a third driven wheel mounted on the other of the camshafts to rotate together therewith, a first power transmitting member passing about the driving wheel and the first driven wheel to transmit rotation of the former to the latter, a second power transmitting member passing about the second driven wheel and the third driven wheel to transmit rotation of the former to the latter and having a tension side section and a slack side section extending between the second and third driven wheels, a pair of first and second adjusting wheels respectively brought into contact with the tension side section and the slack side section of the second power transmitting member and shiftable in unison with each other toward and away from the tension side section and the slack side section so as to vary the lengths of same, and means for driving the adjusting wheels to shift in accordance with operating conditions of the engine.

The above structure is quite effective for solving the above noted problems inherent in the prior art device.

It is accordingly an object of the present invention to provide a novel and improved valve timing control device for a vehicle which is compact in size and reliable in operation.

It is another object of the present invention to provide a novel and improved valve timing control device of the aforementioned character which has an excellent durability.

It is a further object of the present invention to provide a novel and improved valve timing control device of the aforementioned character which makes it possible to obtain optimum efficiency and performance of the engine throughout the operating speed.

BRIEF DESCRIPTION OF THE DRAWINGS

The features and advantages of the valve timing control device according to the present invention will become more clearly appreciated from the following description taken in conjunction with the accompanying drawings, in which.

DETAILED DESCRIPTION OF THE PREFERRED EMBODIMENT

Figure 1:
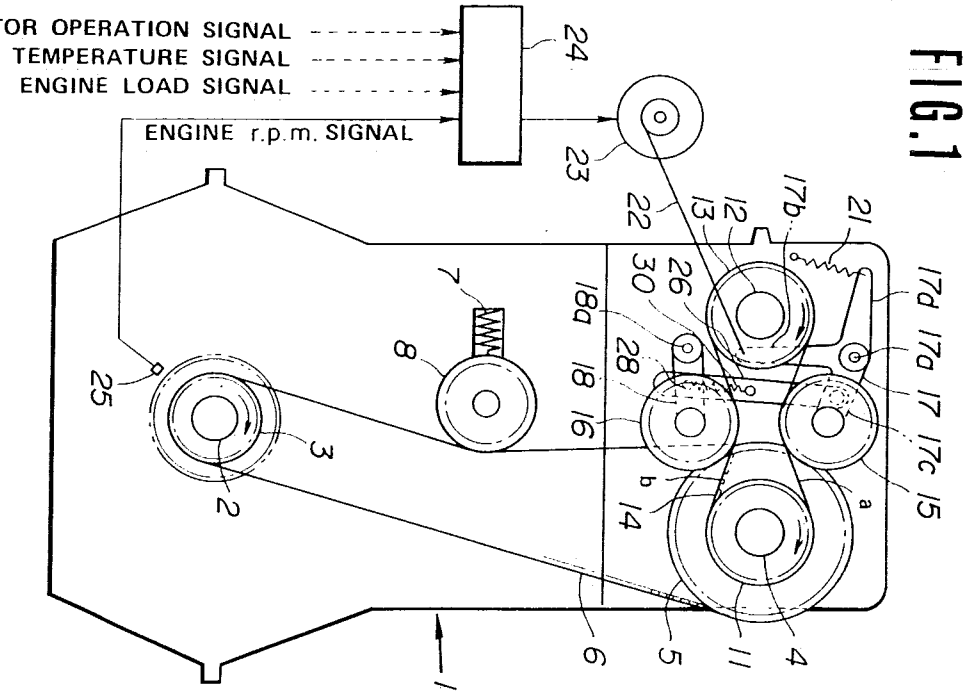
FIG. 1 is a schematic elevational view of an internal combustion engine equipped with a valve timing control device according to an embodiment of the present invention.

Referring to the drawings, a preferred embodiment of the present invention will now be described.

In FIG. 1, a reciprocating internal combustion engine is generally indicated by the reference numeral 1 and includes a crankshaft 2 on which a sprocket 3 is mounted to rotate together therewith. The engine 1 is of the overhead camshaft type and includes a camshaft 4 mounted above a cylinder head (no numeral) for operating an exhaust valve or valves. On the exhaust valve camshaft a first camshaft sprocket 5 is mounted to rotate together therewith. A first timing belt 6 is disposed to pass about the crankshaft sprocket 3 and the first camshaft sprocket 4. The first timing belt 6 is held in a suitably tensioned state by means of an idler pulley 8 which is supported on the engine 1 and urged toward the slack side section of the timing belt 6 under the bias of the spring 7.

In the above, the ratio of the diameter of the crankshaft sprocket 3 to the diameter of the first camshaft sprocket 4 is designed to be 1 to 2 so that the camshaft 4 is driven to rotate at half the speed of the crankshaft 2.

On the camshaft 4 there is further mounted to rotate together therewith a second camshaft sprocket 11 which is sufficiently smaller in diameter than the first sprocket 5. Indicated by the reference numeral 12 is another camshaft for operating an intake valve or valves. On the intake camshaft 12 a third camshaft sprocket 13 is mounted to rotate together therewith. The third camshaft sprocket 13 is equal in diameter to the second camshaft sprocket 11. A second timing belt 14 is disposed to pass about the second and third camshaft sprockets 11, 13.

A pair of adjusting wheels or pulleys 15, 16 are provided which are disposed outside of the timing belt 14 and brought into contact with the tension side section "a" and the slack side section "b" of the second timing belt 14, respectively.

The adjusting pulleys 15, 16 are rotatably mounted on first and second pivotal levers 17, 18 respectively. The first pivotal lever 17 has a T-like shape having three arms 17*b*, 17*c* and 17*d* and pivotally mounted at a place where the three arms 17*b*, 17*c* and 17*d* join on the engine 1 by means of a pivot pin 17*a*. The adjusting pulley 15 is rotatably mounted on the free end of the arm 17*c* of the first pivotal lever 17, while the free end of the arm 17*d* located oppositely to the arm 17*c* is connected to the engine 1 by means of a return spring 21 so that the first pivotal lever 17 is urged by the return spring 21 in the counterclockwise direction, in the drawing, i.e., in the direction causing the adjusting pulley 15 to move away from the timing belt 14. The free end of the arm 17*b* of the first lever 17 located transversely to the arms 17*c*, 17*d* is connected to an electric motor such as for example a stepping motor 23 constituting part of a driving unit for the first and second pivotal levers 17, 18. The second lever 18 is in the form of an elongated bar and pivotally mounted at one end thereof on the engine 1 by means of a pivot pin 18. The adjusting pulley 16 is rotatably mounted on the other end of the second pivotal lever 18.

The stepping motor 23 operates in accordance with control pulse signals applied thereto from a control circuit 24. The control circuit 24 produces the control pulse signals in accordance with input signals representative of the operating conditions of the engine 1. The operating conditions of the engine 1 are represented by an engine r.p.m. signal, engine load signal, engine coolant temperature signal, starter motor operation signal, or the like. In this embodiment, only an engine r.p.m. signal is applied to the control circuit 24 for the purpose of brevity. To this end, a crankshaft angle sensor 25 is provided to detect the r.p.m. of the crankshaft 2 and applies signals representative thereof to the control circuit 24. As the engine r.p.m. increases, the control circuit 24 actuates the stepping motor 23 to pull the wire 22 thereby increasing the length of the tension side section "a" of the second timing belt 14 for the reason which will be explained hereinlater.

Figure 2:
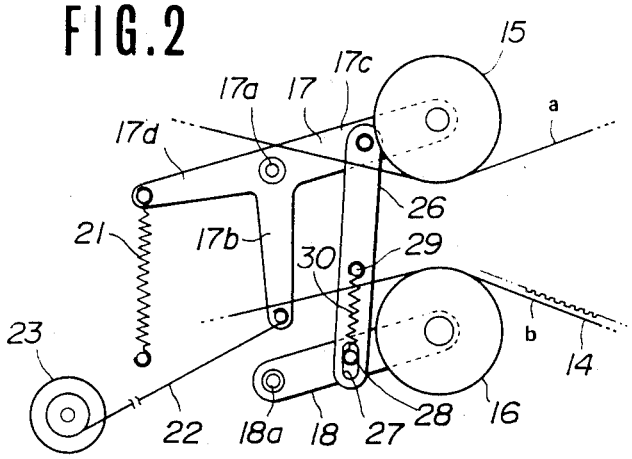
FIG. 2 is an enlarged view of an important portion of the valve timing control device of FIG. 1.

The second lever 18 is swingale together with the first lever 17. To this end, as shown in detail in FIG. 2, a connecting lever 26 is provided which is pivotally mounted at one end thereof on the idler lever arm 17*c* at a location intermediate between the ends thereof. The connecting lever 26 is formed at the other end thereof with an elongated guide slot 27 extending longitudinally thereof. The idler lever 18 has mounted thereon at a location intermediate between the ends thereof a guide pin 28 which is movably received in the guide slot 27. The connecting lever 26 has mounted thereon at a location intermediate between the ends thereof a pin 29. A tension spring 30 is provided which is attached at the opposed ends thereof to the guide pin 28 and the pin 29, respectively.

The pivotal levers 17, 18, wire 22, stepping motor 23, control circuit 24 and the crankshaft angle sensor 26 thus constitute a drive unit for driving the adjusting pulleys 15, 16.

The operation of the valve timing control device constructed and arranged as above according to the present invention will now be described.

When the engine 1 is started, the crankshaft 2 rotates. The rotation of the crankshaft 2 is transmitted to the exhaust valve camshaft 4 through the first timing belt 6 and the first camshaft sprocket 5, thereby causing the exhaust valve camshaft 4 to rotate. Since the diameter of the first camshaft sprocket 5 is twice the diameter of the crankshaft sprocket 3, the speed of the former is half the speed of the latter.

The above rotation of the exhaust valve camshaft 4 is transmitted to the intake valve camshaft 12 through the second timing belt 14 and the third camshaft sprocket 13, causing the intake valve camshaft 12 to rotate at the speed equal to that of the exhaust valve camshaft 4 since the sprockets 11, 13 are equal in diameter to each other.

Figure 3:
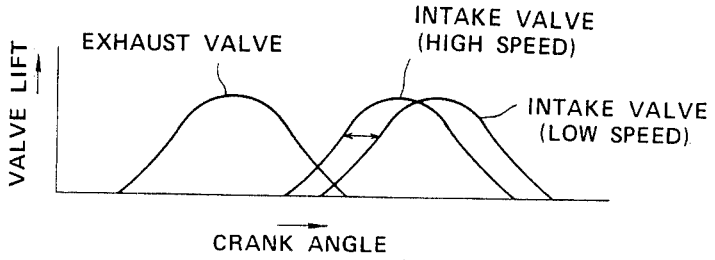
FIG. 3 is a graph of the valve lift curves provided by the control device of FIG. 1.
Figure 4:
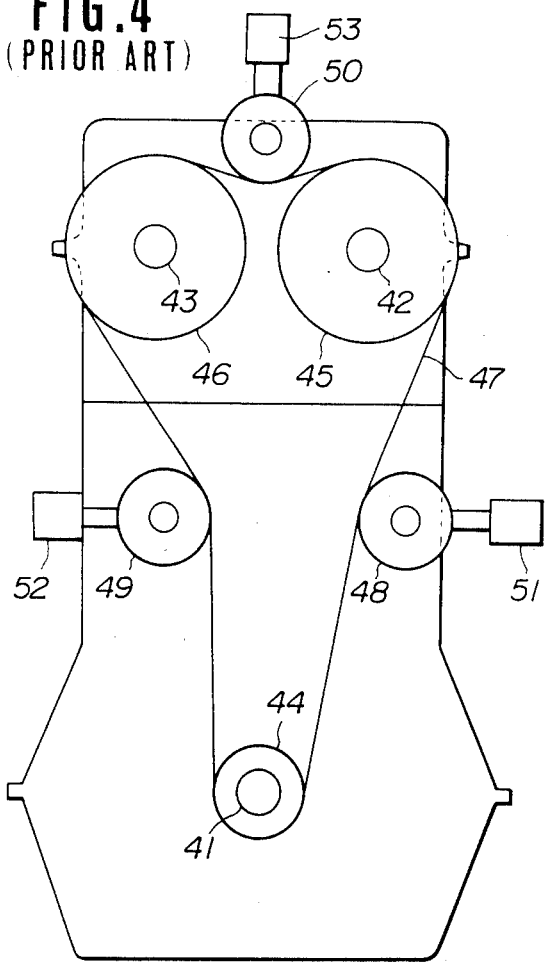
FIG.4 (PRIOR ART)
FIG. 4 is a schematic elevational view of an internal combustion engine equipped with a prior art valve timing control device.

Now, suppose the engine 1 is rotating at a low speed with the intake and exhaust valves being given predetermined phases to operated at the predetermined timings as shown in FIG. 3 and thereafter the speed of the engine 1 is increased beyond a certain predetermined value into a high speed range. Such a high speed condition of the engine 1 is detected by the crankshaft angle sensor 25 which in turn applies an engine speed signal representative thereof to the control circuit 24. The control circuit 24 then applies an input signal to the stepping motor 23 to wind up the wire 22. By this, the first pivotal lever 17 is caused to rotate in the clockwise direction in the drawing by a predetermined angle against the bias of the return spring 21, whereby to increase the tension of the tension side section "a" of the timing belt 14. At this moment, since the relative phase between the exhaust valve camshaft 4 and the crankshaft 2 is mainted at a fixed value, increase in the tension of the tension side section "a" of the timing belt 14 causes the tension side belt section "a" to be drawn in the rightward direction in the drawing, thereby causing the third camshaft sprocket 13 to rotate in the direction of the arrow in the drawing (i.e. in the "advance" direction) and advancing the timing of the exhaust valve as shown in FIG. 3. By this, the overlapping period at which both the intake and exhaust valves are held opened is increased, whereby to make it possible to obtain optimum efficiency and performance of the engine 1 operating at a certain high speed.

On the other hand, while the slack side section "b" of the second timing belt 14 becomes shorter by the amount corresponding to the increased length of the tension side section "a", the connecting lever 26 causes the second pivotal lever 18 to rotate in the clockwise direction as the first pivotal lever 17 rotates in the corresponding direction, thereby to cause the adjusting pulleys 16 to move downward in the drawing and prevent increase in tension of the slack side section "b" of the second timing belt 14.

In this instance, the tension of the tension spring 30 is adapted to be balanced with that of the slack side section "b" of the timing belt 14 and hold the same in a predetermined tensioned state.

When the speed of the engine 1 is reduced into a low speed range, the valve timing control device operates in the manner reverse to the above and retards the timing of the intake valve. By this, as shown in FIG. 3, the overlapping period at which both of the intake and exhaust valves are held open is reduced, whereby to make it possible to obtain optimum efficiency and performance of the engine 1 operating at a certain low speed.

In the above, since the sprockets 11, 13 can be of the small diameter, the distance between the axes thereof can be made sufficiently smaller. By the effect of this, the overall length of the timing belt 14 can be sufficiently small with the result that a small shift of the adjusting pulley 5 can cause a large variation in the length of the tension side section "a" of the timing belt 14 and therefore a large variation in the relative phase between the camshafts 4, 12 to advance or retard the timing of the intake valve largely. As a result, a given variation in the timing of the intake valve can be attained by the smaller displacements of the adjusting pulleys 15, 16 than before, making it possible to reduce the size of the drive unit for driving the adjusting pulleys 15, 16 and therefore the overall size of the valve timing control device.

Furthermore, since the overall length of the second timing belt 14 is small, the amount of elongation of the timing belt 14 due to secular can be small, making it possible to attain an accurate and reliable valve timing control. Particularly, since the length of the slack side section "b" of the second timing belt 14 is small and the adjusting pulleys 15, 16 are arranged to contact the tension side section "a" and the slack side section "b" of the timing belt 14, swinging of the timing belt 14 during adjustment or variation of the valve timing can be suppressed, making it possible to prevent the timing belt 14 from skipping some teeth of the sprockets 11, 13.

Furthermore, by the effect of the small-sized sprockets 11, 13 and the small distance between the axes of same, an increased space can be obtained therearound. Due to this, not only the layout of the adjusting pulleys 15, 16 becomes easier but also the engine 1 can be smaller in size than before. Yet furthermore, it is advantageous that the stepping motor 23 is employed to shift the adjusting pulleys 15, 16 since the stepping motor 23 can be installed at a place where it is least influenced by vibrations and heat, making it possible to attain an increased durability or life of the stepping motor 23.

In this embodiment, the second pivotal lever 18 for the third adjusting pulley 16 and the connecting lever 26 are linked to each other by means of the guide pin 28, guide slot 27 and spring 30, resulting in that accurate dimensions of those parts become unncessary since variations in the dimensions thereof can be compensated for by the guide pin 28 and the guide slot 27 which are movable relative to each other. Particularly, when such a case happens in which the adjusting pulleys 15, 16 are actuated to swing largely, the guide pin 28 is brought into contact with the end of the guide slot 27 to suppress the swinging of the adjusting pulleys 15, 16, thus making it possible to prevent the timing belt 14 from skipping some teeth of the sprockets 11, 13.

While the adjusting levers 17, 18, connecting lever 16, stepping motor 23 and control circuit 24, etc. are employed to constitute the driving unit for driving the adjusting pulleys 15, 16, this is not limitative, for example, hydraulic cylinders may be employed in place thereof. Furthermore, the camshafts 4, 12 may be modified so that the camshaft 4 operates the intake valve or valves and the camshaft 12 for the exhaust valve or valves. Yet furthermore, the stepping motor 23 is not limited to the two-step type as in the embodiment but may be replaced by a motor of the stepless type.

What is claimed is:

1. A valve timing control device for an engine having a crankshaft and a pair of camshafts for operating intake and exhaust valves, comprising:

a driving wheel mounted on the crankshaft to rotate together therewith;

a pair of first and second driven wheels mounted on one of the camshafts to rotate together therewith;

a third driven wheel mounted on the other of the camshafts to rotate therewith;

a first power transmitting member passing about said driving wheel and said first driven wheel to transmit rotation of the former to the latter;

a second power transmitting member passing about said second driven wheel and said third driven wheel to transmit rotation of the former to the latter and having a tension side section and a slack side section extending between said second and third driven wheels;

a pair of first and second adjusting wheels respectively brought into contact with said tension side section and said slack side section of said second power transmitting member and shiftable in unison with each other toward and away from said tension side section and said slack side section so as to vary the lengths of same; and means for driving said adjusting wheels to shift in accordance with operating conditions of the engine.

2. A valve timing control device as set forth in claim 1, in which said driving means comprises a pair of first and second pivotal levers on which said first and second adjusting wheels are rotatably mounted, respectively, a connecting lever interconnecting said pivotal levers in a manner to allow them to swing together, and an electric motor for driving said first adjusting wheel to swing.

3. A valve timing control device as set forth in claim 2, in which said first pivotal lever has a T-like shape having first, second and third arms and pivotally mounted on the engine at a place where said three arms join, said first adjusting wheel being rotatably mounted on the free end of said first arm while the free end of said second arm located oppositely to said first arm being connected to the engine by means of a return spring so that said first pivotal lever is urged by said return spring in the direction causing said first adjusting wheel to move away from said second power transmitting member, the free end of said third arm arranged transversely to said first and second arms being operatively connected to said electric motor so that said first adjusting wheel is driven by said electric motor toward said second power transmitting member against the bias of said return spring.

4. A valve timing control device as set forth in claim 3, in which said second pivotal lever is in the form of an elongated bar and pivotally mounted at one end thereof on the engine, said second adjusting wheel being rotatably mounted on the other end of said second pivotal lever.

5. A valve timing control device as claimed in claim 4, in which said connecting lever is in the form of an elongated bar and pivotally connected at one end thereof to said first arm of said first pivotal lever, said connecting lever having at the other end thereof a guide slot elongated longitudinally thereof, said second pivotal lever having mounted at a location intermediate between the ends thereof a guide pin which is movably received in said guide slot, said connecting lever having attached thereto an end of a tension adjusting spring whose other end is connected to said guide pin so as to hold said slack side section of said second power transmitting member in a predetermined tensioned state.

6. A valve timing control device as set forth in claim 1, in which said second and third driven wheels are equal in diameter and smaller in diameter than said first driven wheel.

7. A valve timing control device as set forth in claim 1, in which said driving and driven wheels comprise sprockets, and said first and second power transmitting members comprise timing belts.

* * * * *